US007922632B2

(12) United States Patent
Chou

(10) Patent No.: US 7,922,632 B2
(45) Date of Patent: Apr. 12, 2011

(54) MULTIFUNCTIONAL PHYSICAL TRAINING DEVICE

(75) Inventor: Cheng I Chou, Prairie View, IL (US)

(73) Assignee: Body Solid Inc., Forest Park, IL (US)

( * ) Notice: Subject to any disclaimer, the term of this patent is extended or adjusted under 35 U.S.C. 154(b) by 0 days.

(21) Appl. No.: 12/503,218

(22) Filed: Jul. 15, 2009

(65) Prior Publication Data

US 2010/0016129 A1 Jan. 21, 2010

Related U.S. Application Data

(60) Provisional application No. 61/135,059, filed on Jul. 16, 2008.

(51) Int. Cl.
*A63B 21/06* (2006.01)

(52) U.S. Cl. ..... 482/103; 482/100; 482/138

(58) Field of Classification Search ..... 482/92–94, 482/99–103, 138; D21/676
See application file for complete search history.

(56) References Cited

U.S. PATENT DOCUMENTS 4,709,918 A * 12/1987 Grinblat ..... 482/70
4,898,381 A * 2/1990 Gordon ..... 482/103
5,211,614 A * 5/1993 Henes ..... 482/102
6,443,877 B1 * 9/2002 Hoecht et al. ..... 482/103
7,537,554 B2 * 5/2009 Zhuang ..... 482/142
7,575,538 B1 * 8/2009 Clark ..... 482/103
2002/0091043 A1 * 7/2002 Rexach ..... 482/98
2003/0100413 A1 * 5/2003 Huang ..... 482/100
2004/0009856 A1 * 1/2004 Hammer ..... 482/99
2006/0100069 A1 * 5/2006 Dibble et al. ..... 482/98
2006/0189457 A1 * 8/2006 Ripley ..... 482/99
2007/0184944 A1 * 8/2007 Huang ..... 482/94
2008/0051263 A1 * 2/2008 Rasmussen et al. ..... 482/94
2008/0051267 A1 * 2/2008 Ish ..... 482/99
2008/0096735 A1 * 4/2008 Grider ..... 482/99
2008/0300116 A1 * 12/2008 Eder ..... 482/100
2009/0149302 A1 * 6/2009 Thuma et al. ..... 482/99
2009/0170668 A1 * 7/2009 Giannelli et al. ..... 482/94
2009/0170669 A1 * 7/2009 Giannelli et al. ..... 482/103

* cited by examiner

*Primary Examiner* — Patricia M Bianco
*Assistant Examiner* — Victor K Hwang
(74) *Attorney, Agent, or Firm* — Clifford Kraft

(57) ABSTRACT

A multipurpose personal training device with a pair of press arms that can be set to numerous different lateral angles. Each press arm can be equipped with a functional trainer handle coupled by cable and pulleys to an adjustable weight engine. The final pulley at the end of each arm is free to rotate to any angle. In addition to exercises involving the arms, the device can supply a full complement of most standard training exercises.

3 Claims, 6 Drawing Sheets

MULTIFUNCTIONAL PHYSICAL TRAINING DEVICE

This application is related to and claims priority from U.S. Provisional Patent Application No. 61/135,059 filed Jul. 16, 2008. Application 61/135,059 is hereby incorporated by reference.

BACKGROUND

Field of the Invention

The present invention relates generally to the field of personal training devices and more particularly to a multifunctional training machine that has press arms that can independently move to numerous relative positions with functional trainer handles cabled to a weight engine through the same structure as the press arms.

Prior art training machines are known with press arms that can move to various angles. The prior art does not teach a functional trainer that can pull weight through cables that pass through the structure of the press arms. Also, the prior art does not show these cables passing through a freely rotating pulleys at the exercise end of the press arms.

SUMMARY OF THE INVENTION

The present invention relates to a multifunction personal training device that allows many different types of exercises. The device has a pair of press arms that can be set to numerous lateral angles. These arms also contain a cable and pulley system for a functional trainer handle emanating from the press arm with the cables passing through the structure of the arm. The functional trainer handle normally has complete, or almost complete, rotational freedom about the axis of the pull arm. In addition to exercises involving the arms, the device can supply a full complement of most standard training exercises.

DESCRIPTION OF THE FIGURES

Attention is now directed to several figures that illustrate aspects of the present invention.

Several drawings and illustrations have been presented to aid in understanding features of the present invention. The scope of the present invention is not limited to what is shown in the figures.

DESCRIPTION OF THE INVENTION

The present invention relates to a multifunction personal training device with a pair of press arms that can be set to numerous iso-lateral angles through a range of greater than 180 degrees and preferably at least 250 degrees. These arms can also contain a cable and pulley system for a functional trainer handle emanating from each press arm with the cables passing through the structure of the arm to a weight engine. Each functional trainer handle normally has complete rotational freedom about the longitudinal axis of its associated pull arm.

Figure 1:
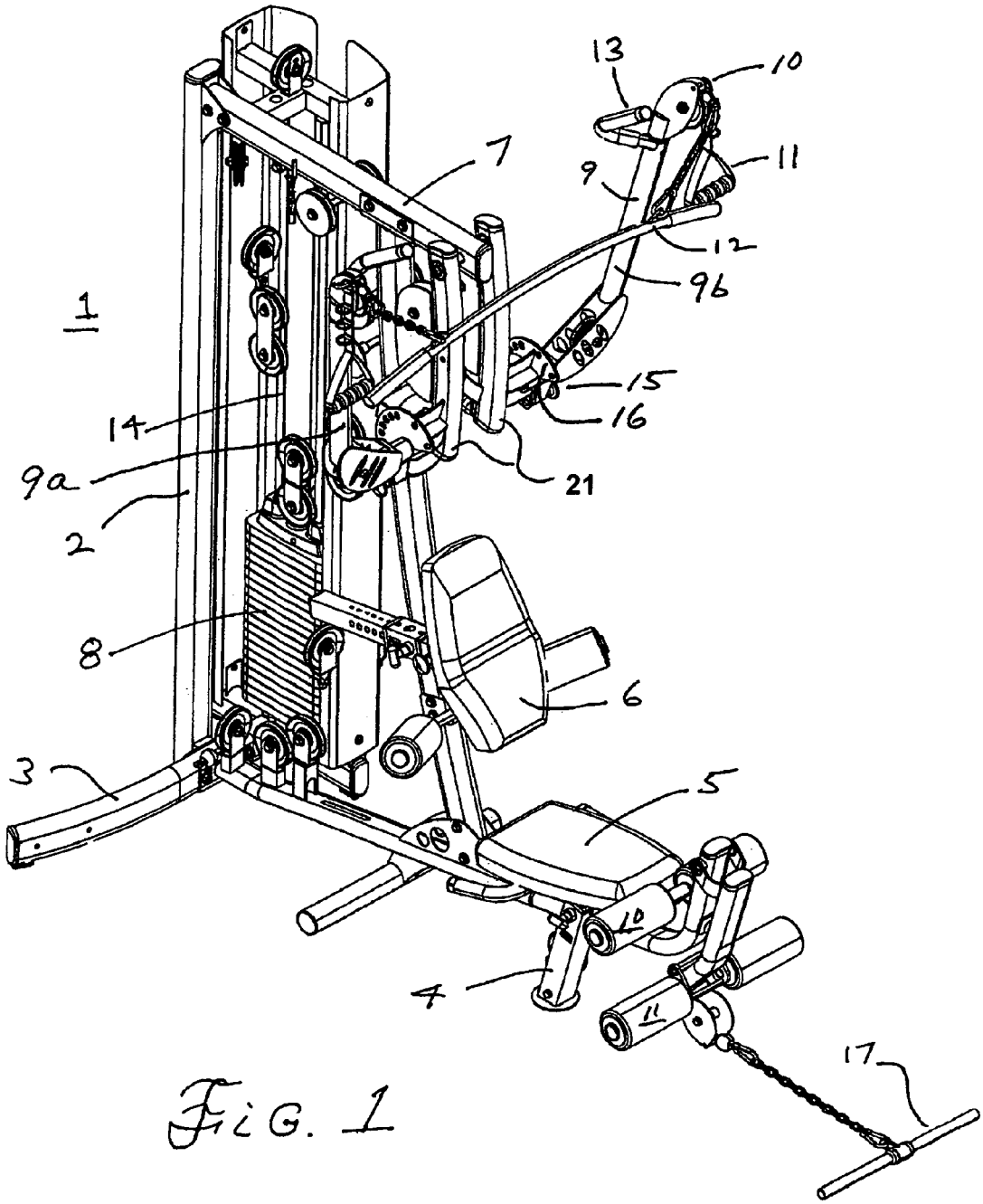
FIG. 1 shows a perspective view of an embodiment of the present invention.

Turning to FIG. 1, a perspective view of an embodiment of the device 1 can be seen. A vertical frame member 2 on legs 3,4 supports one or more weight engines 8, a top horizontal bar 7 and a cable/pulley system 14. An adjustable seat 5 and backrest 6 allow a user to sit for arm or leg exercises. A leg lift assembly 18, 19 allows leg lift type exercises. A pull chain with handle 17 can be used in conjunction with leg exercises. A pair of descending members 21 attached at one end to the top horizontal bar 7 descend approximately parallel to the vertical frame or back member 2, and are attached to a pair of independent press arms 9*a*, 9*b* that are pivotably coupled to the descending members 21 through a pivot arrangement 15, 16.

The embodiment of FIG. 1 has generally two press arms 9*a*, 9*b* which can assume numerous different lateral angles using a pin selector 15, 16. These arms can work together or independently. Each arm can be individually positioned to a particular lateral angle. Press exercises can be performed using handles 13 on the end of the arms 9. Each arm has a functional trainer handle 11 with a cable that passes through the structure of the press arm 9 and is coupled to the weight engine 8. The functional trainer cable passes through a pulley 10 on each arm. Each of these pulleys can freely rotate to give the functional trainer almost complete rotational freedom about the axis of the press arm 9. An optional pull bar 12 can be attached to the press arms 9.

Figure 2:
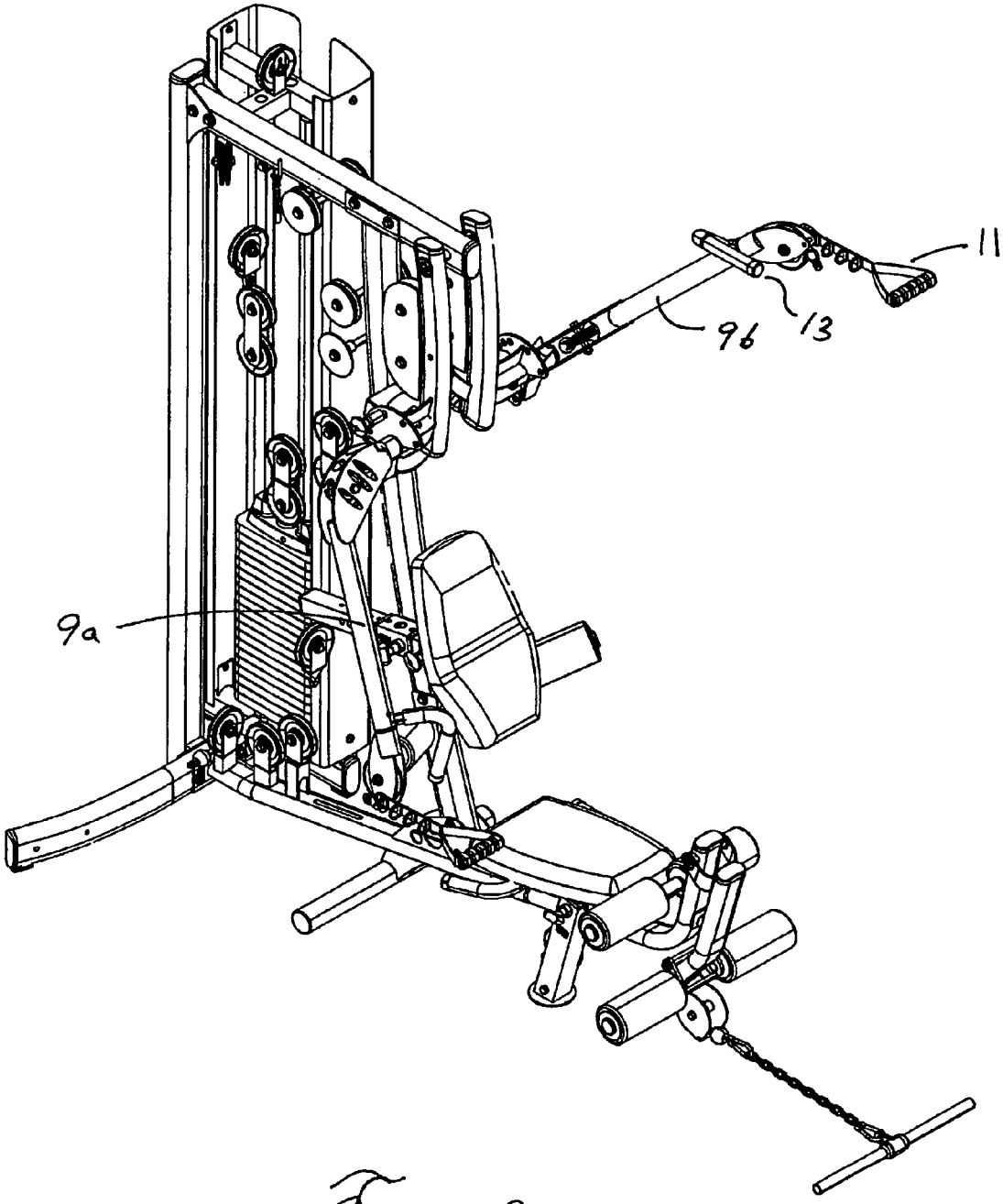
FIG. 2 shows embodiment of FIG. 1 with the arms in a different position.
Figure 3:
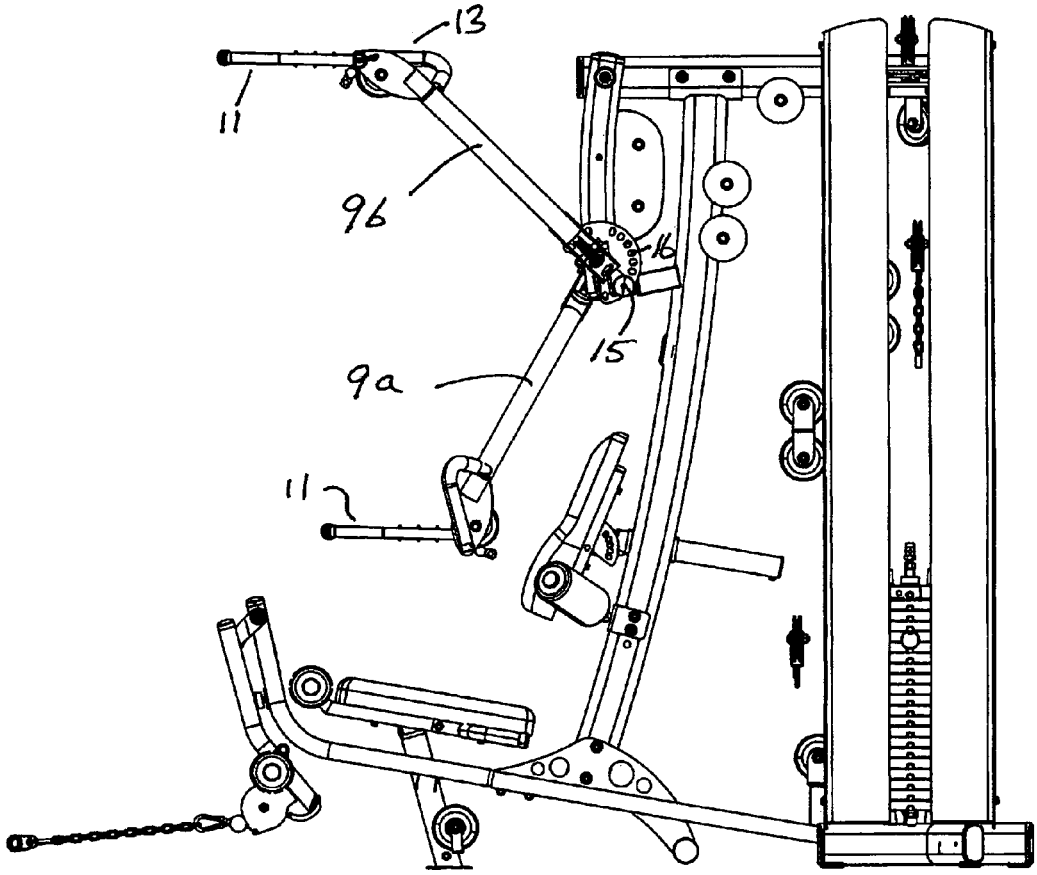
FIG. 3 shows a side view of the embodiment of FIG. 1.

FIG. 2 shows the embodiment of FIG. 1 with the two press arms 9*a*, 9*b* in different positions from those shown in FIG. 1. In FIG. 1, both arms 9 are up; in FIG. 2, the left arm 9*b* is at about 45 degrees, while the right arm 9*a* is down. Numerous exercises can use either one or both of the functional trainer pull handles 11. FIG. 3 shows a side view of the embodiment with cables removed. The left press arm 9*b* is up, while the right press arm 9*a* is down. Adjustment of the lateral angle of a particular arm can be set using a spring pin 15 and lock plate 16. While a pin and plate are preferred, any method or device for locking the arm at a particular angle is within the scope of the present invention.

Figure 4:
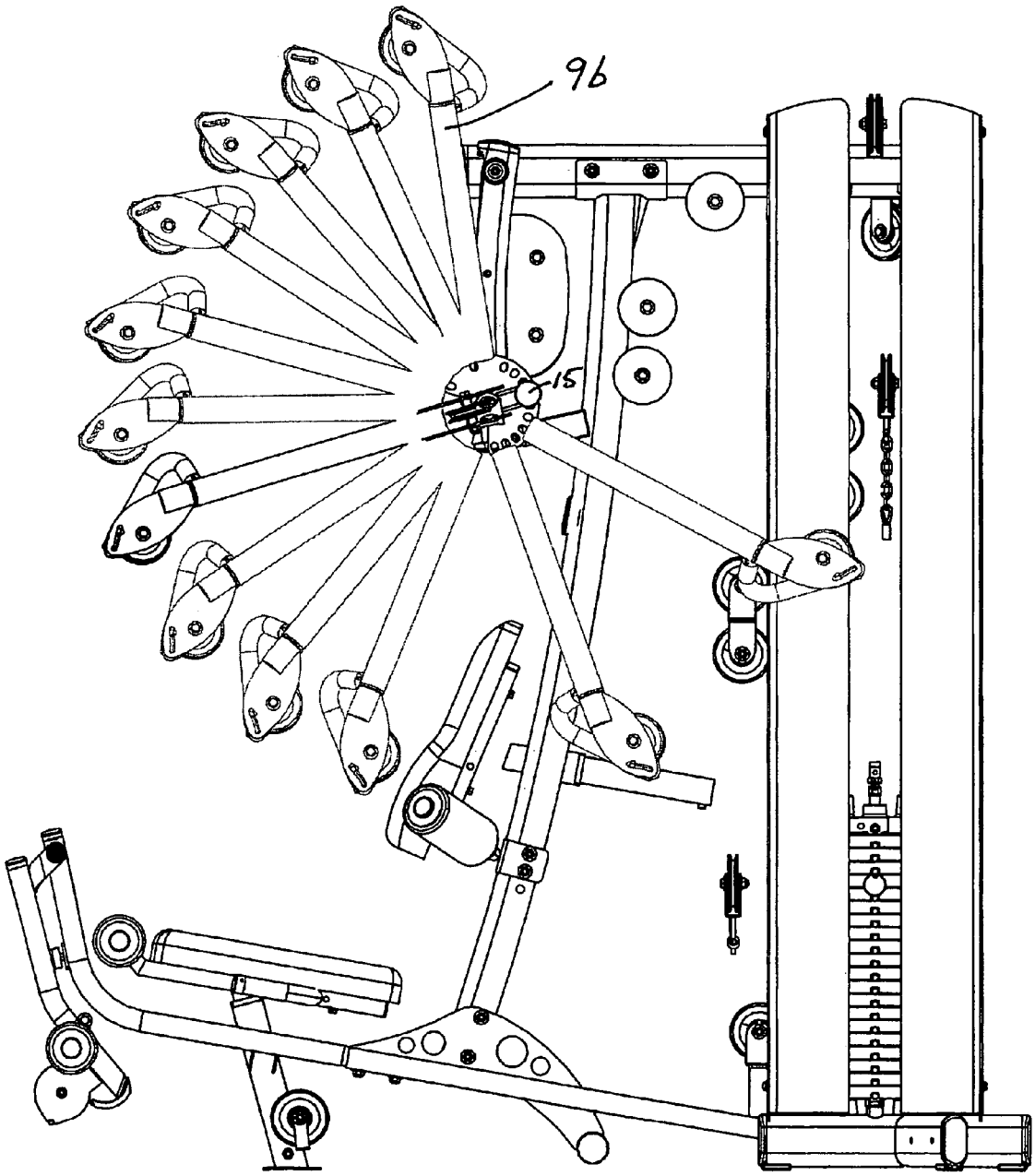
FIG. 4 shows the range of movement of the press arms from a side view.

FIG. 4 illustrates some of the angular positions the arm 9*b* can take by simply pulling the spring pin 15 and moving the arm to a new position. This wide range of fixed lateral positions allows numerous exercises to be performed using either the arm or the functional trainer pull handle 11. The preferred range of angles is at least 250 degrees; however, any angular range, including angles greater than 180 degrees, is within the scope of the present invention.

Figure 5:
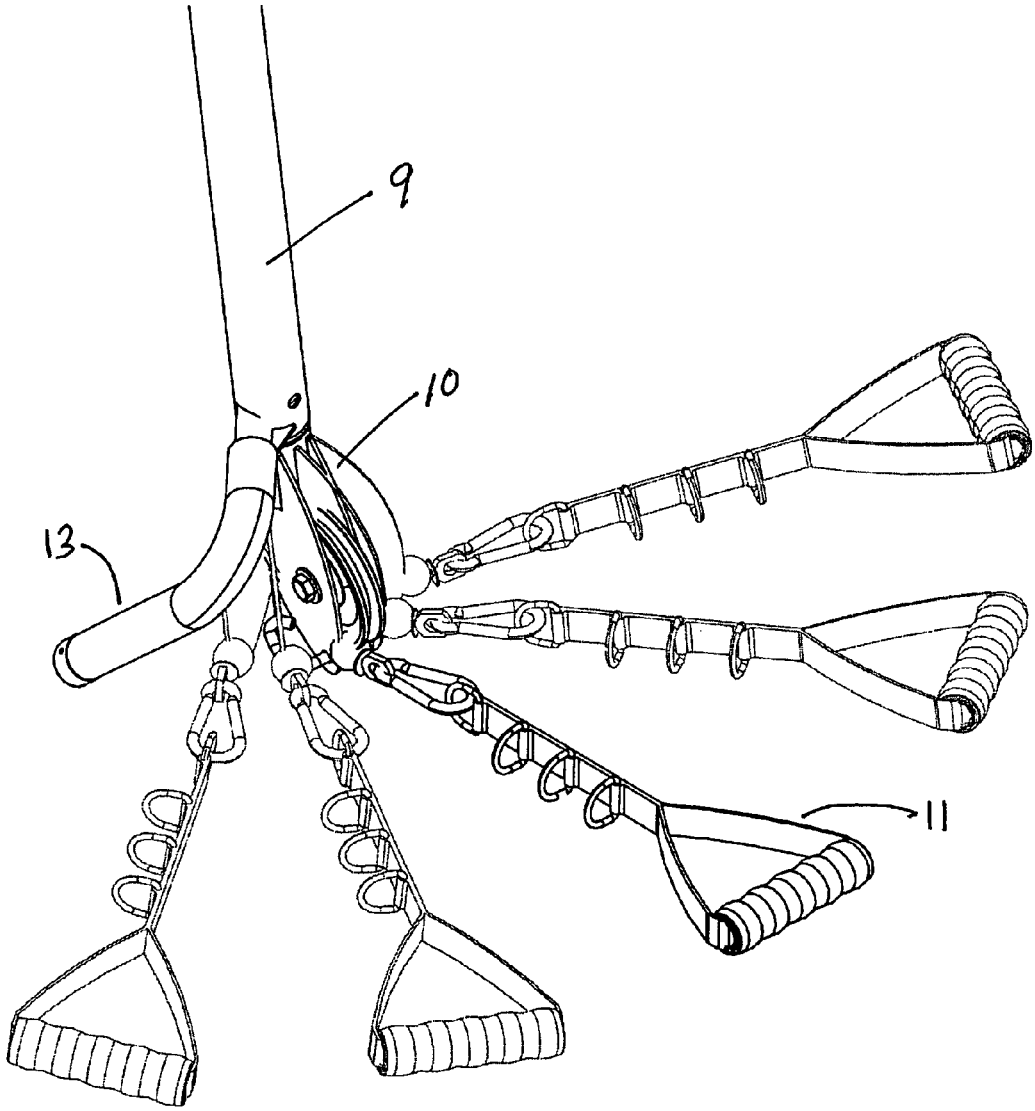
FIG. 5 shows the range of movement of the functional trainer on one of the press arms.

The functional trainer pulley 10 on each of the arms 9 can rotate through a free range of angles as shown in FIG. 5. The pull bar 12 can engage the weight engine 8 in all of these angular positions when pulled. FIG. 5 also shows a press arm handle 13 that can be used instead of the functional trainer handles.

Figure 6:
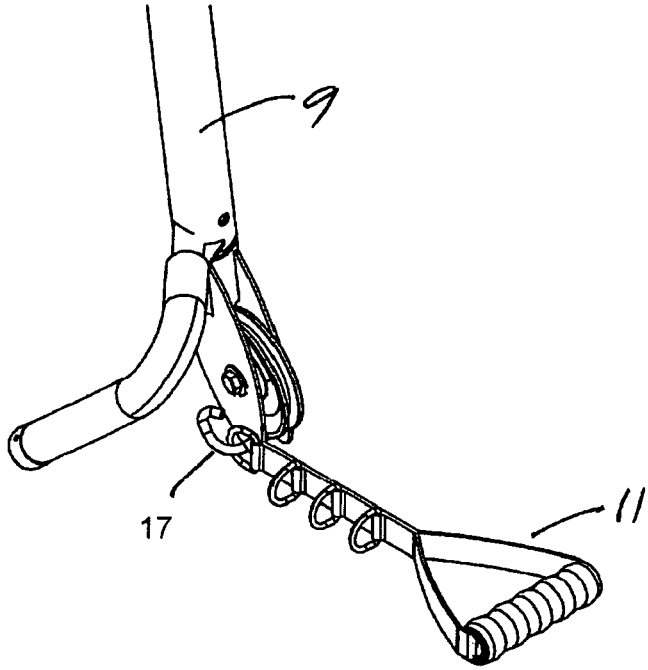
FIG. 6 shows the training handle directly attached to the press arm.

As shown in FIG. 6, the functional trainer handle 11 may also optionally be directly attached to the arm 9 with a hook 20. This allows the handle to be used for exercises in conjunction with the rigid bar 9 in any of its angular lateral positions.

Several descriptions and illustrations have been presented to aid in understanding the present invention. One skilled in the art will realize that numerous changes and variations can be made without departing from the spirit of the invention. Each of these changes and variations is within the scope of the present invention.

I claim:

1. A training apparatus comprising, in combination:

a frame with an elongated base, a vertical back member and a top member approximately parallel to said base;

a weight engine attached to said frame;

a seat attached to said base;

an inclined back support aft of said seat, said seat and back support adapted so a user can sit facing away from said frame;

a pair of descending members approximately parallel to said vertical back member, said descending members attached to said top member;

a pair of independent press arms, each having a longitudinal axis, pivotally coupled to said descending members, each of said press arms being separately laterally adjustable through a plurality of angles, said plurality of angles having an angular range greater than 180 degrees;

each of said press arms also having a functional trainer pull handle coupled by a cable to the weight engine, the cable terminating into said pull handle at a distal end of said press arm through a pulley with a free range of angular movement about the longitudinal axis of said press arm; and wherein each of said press arms is separately adjustable to one of said plurality of angles with a pin and lock plate; and wherein each of said functional trainer pull handles is adapted to optionally be directly attached to one of said press arms by a fastener on said press arm; and a leg lift assembly forward of said seat, said leg lift assembly also including a pull chain and handle.

2. The training apparatus of claim 1 wherein said angular range is at least 250 degrees.

3. The training apparatus of claim 1 further comprising a pull bar attached between the distal ends of said independent press arms.

* * * * *